United States Patent [19]

Bulanda et al.

[11] 4,128,919

[45] Dec. 12, 1978

[54] METAL TIE

[75] Inventors: John J. Bulanda, New Lenox; Casimir M. Guzay, Des Plaines; Bruce A. Betitschke, Oaklawn, all of Ill.

[73] Assignee: Panduit Corp., Tinley Park, Ill.

[21] Appl. No.: 836,272

[22] Filed: Sep. 26, 1977

[51] Int. Cl.[2] ..... B65D 63/02

[52] U.S. Cl. ..... 24/20 TT

[58] Field of Search ..... 24/16 R, 16 PB, 20 R, 24/20 EE, 20 TT

[56] References Cited

U.S. PATENT DOCUMENTS

| | | | |
|---|---|---|---|
| 747,811 | 12/1903 | Walker | 24/20 TT |
| 811,343 | 1/1906 | Walker | 24/20 TT |
| 1,176,181 | 3/1916 | Thomas | 24/20 TT |
| 3,748,697 | 7/1973 | Marchese et al. | 24/20 TT |

*Primary Examiner*—Henry S. Jaudon

*Attorney, Agent, or Firm*—Charles R. Wentzel; Richard B. Wakely

[57] ABSTRACT

A tie for forming a plurality of elongate objects into a bundle and for holding two objects together. The tie includes an elongate strap having a plurality of spaced abutments therealong and a metal locking head joined to one end of the strap. The locking head comprises a floor with a strap-receiving aperture therethrough and a locking tongue for engaging one of the abutments. The tongue and floor are joined by a resilient neck from which the tongue extends toward the floor to at least partially overlie the aperture. Threading of the strap causes the tongue to deflect away from the floor and the tongue lockingly engages one of the abutments upon attempted retrograde movement of the strap.

24 Claims, 14 Drawing Figures

METAL TIE

BACKGROUND OF THE INVENTION

The present invention relates generally to bundling and attachment apparatus and more specifically to a tie for forming a plurality of elongate objects into a bundle and holding a pair of objects together.

Cable ties formed of thermoplastic material have been developed during the last twenty years and such ties have become increasingly popular for a variety of bundling and attachment applications because of their relatively low initial cost and their ease of installation. For certain other applications, however, plastic ties have limitations when compared to ties formed of metal. More specifically, plastic straps tend to become brittle when used at low temperature and have less desirable aging characteristics than similar metal straps; e.g., when used in a high temperature, high humidity environment, plastic ties may exhibit some elongation. Additionally, plastic ties are inappropriate for certain nuclear powerplant applications since radiation can result in degradation of the plastic material thereby rendering the strap more brittle. Also where it is desired to use the tie as a load carrying member the metal tie is sometimes preferable since it has the greater tensile strength.

Several self-locking bundling devices formed from metal have been proposed. Typically they include a strap having a plurality of regularly spaced vanes struck from the blank from which the strap is formed and extending at an angle relative to the strap surface. After the strap is positioned to encompass the objects to be held, strap portions must be overlapped so that the vanes of the respective strap portions interleave. Generally a keeper is provided which encircles the overlapped strap portions to hold them in engagement. The locking vanes extend from either one or both surfaces of the strap. If the vanes extend from the surface of the strap disposed adjacent the held objects, the relatively sharp edges of the vanes could damage the objects, particulaly if they are insulated electrical conductors. Even if the vanes extended only from the surface of the strap disposed, in use, away from the conductors, the vanes could damage the insulation of conductors in other bundles where several bundles are run adjacent one another through a high density wiring area. Of course, the requirement of overlapping strap portions necessitates that such devices be significantly longer than the circumference of the bundle. Some bundling devices of this class include a keeper which is fixed to the strap. It will be appreciated that with this configuration forces required to thread the free end of the strap through the keeper are relatively high as a plurality of vanes must be simultaneously deflected. Reference may be made to U.S. Pat. Nos. 3,311,957, 3,694,863 and 3,964,133 which show examples of such prior art bundling devices.

Metallic hose clamps have been proposed which include a locking head joined to one end of the strap and have a locking tongue for reception in apertures spaced along the strap. The tongues used in these clamps are in the form of a short beam thus requiring relatively high threading force to deflect the tongue. Additionally, the tongue typically extends outside the locking head making the clamps inappropriate for use with a tool which severs the excess threaded portion of the strap flush with the locking head. Examples of such prior art hose clamps are shown in U.S. Pat. Nos. 3,189,961 and 3,748,697.

SUMMARY OF THE INVENTION

Among the several objects of the present invention may be noted the provision of an improved self-locking tie for forming objects into a bundle and for holding a pair of objects together; the provision of such a tie which makes it satisfactory for use in high temperature, low temperature and other harsh environments; the provision of such a tie which permits tightening without damaging the held objects; the provision of such a tie which has high tensile strength and relatively low threading force and the provision of such a tie which is lightweight, has long service life and is simple and economical to manufacture. Other objects and features will be in part apparent and in part pointed out hereinafter in the description and claims.

Briefly, the tie of the present invention includes an elongate strap and a metal locking head joined to the strap. The strap has a plurality of spaced abutments and the head includes a floor having a strap-receiving aperture and a locking tongue for engaging one of the abutments. The tongue and floor are joined by a resilient neck with the tongue extending from the neck toward the floor to at least partially overlie the aperture.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
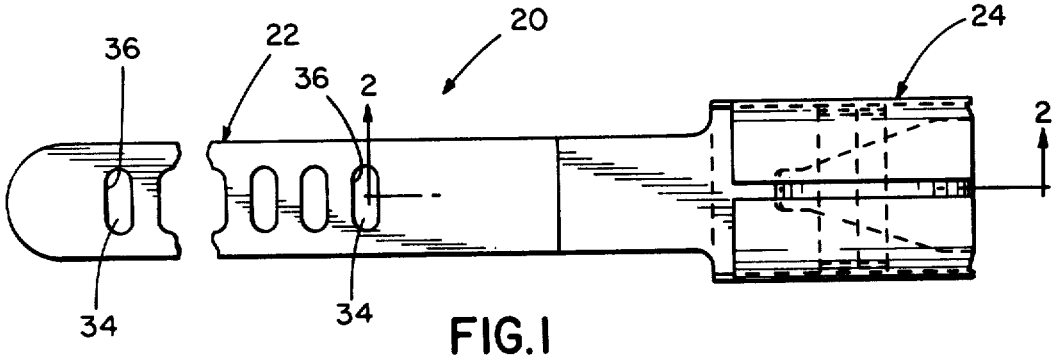
FIG. 1 is a plan of a self-locking tie of the present invention including a strap and a locking head.

Referring now to the drawings, a self-locking tie for forming a plurality of elongate objects into a bundle and for holding two objects together is generally indicated in FIG. 1 by reference numeral 20. Tie 20 comprises an elongate strap 22 joined to an elongate locking head 24 for receiving and holding the free end of the strap. Tie 20 is preferably made of metal and, more particularly, stainless steel to have high strength, be corrosion resistant, and to be usable over a wide temperature range. The strap and head can be integrally formed or can be joined by any suitable means, for example, by spot welding. The strap and the head are preferably formed from stock having a thickness of 0.008 inch.

Figure 2:
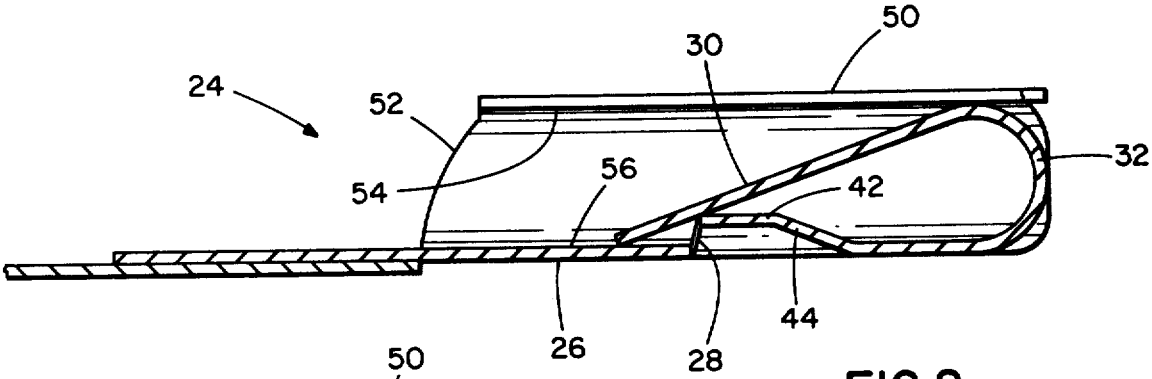
FIG. 2 is an enlarged sectional view of the head taken generally along line 2—2 of FIG. 1 showing a locking tongue carried by the head.

More specifically as shown in FIG. 2, locking head 24 includes a floor 26 having a strap-receiving aperture 28 and further includes a locking tongue 30 joined to the floor by a resilient neck 32 with the tongue tapering as its extends from the neck towards the floor to overlie aperture 28 so as to be deflected upon threading of the strap into the head. Strap 22 is provided with a plurality of longitudinally spaced apertures 34 for sequentially receiving tongue 30 as the strap is threaded into locking head 24. Each aperture 34 is partially defined by a transverse surface 36 serving as an abutment for locking tongue 30.

Figure 4:
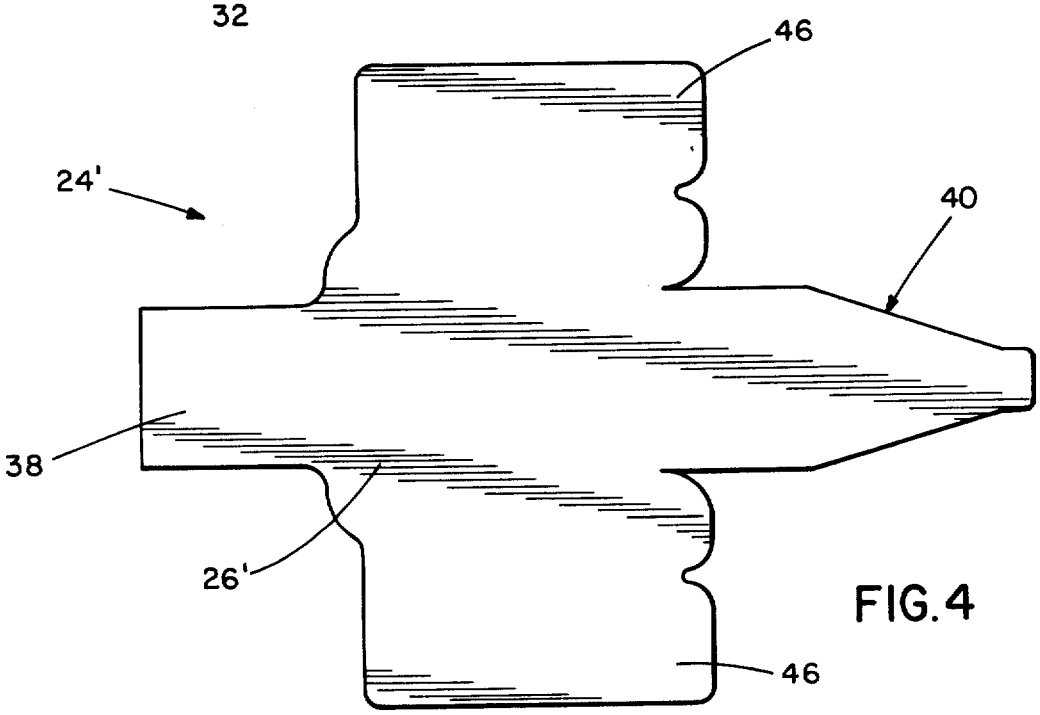
FIG. 4 is a plan of a blank from which the locking head of the present invention is formed.

Referring to FIG. 4, a flat metal blank is shown from which locking head 24 is formed. The blank or components thereof generally corresponding to the head or components thereof except for punching or bending or folding are designated by applying a prime (') to the reference numeral assigned the locking head or component thereof. Blank 24' has an elongate floor portion, 26' from which extend in opposite directions a lip 38 for connection to one end of strap 22, and an extension 40 which is folded back to overlie floor 26 thereby forming neck 32 and tongue 32. Referring to FIGS. 2 and 4, locking head 24 includes stop means for abutting tongue 30 upon attempted removal of the strap from the locking head. The stop means comprises a platform 42 raised relative to floor 26 and including a guide surface 44 for directing the leading end of the strap into strap-receiving aperture 28. Platform 42 is preferably struck from floor portion 26'.

Figure 3:
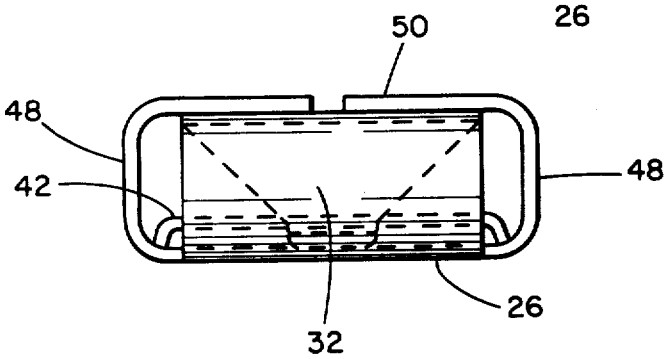
FIG. 3 is an end view of the tie of FIG. 1.

Again referring to FIG. 4, blank 24' further comprises a pair of arms 46 extending laterally in opposite directions from floor portion 26'. Each arm 46 is bent to extend substantially perpendicular to floor 26 to form side walls 48 of the head, as shown in FIG. 3, and bent again so that the distal end of the arms are facing thereby forming a ceiling 50 of locking head 24. Floor 26, side walls 48, and ceiling 50 define a strap exit face 52 of the locking head. Ceiling 50 includes a surface 54, see FIG. 2, for guiding the leading end of strap 22 toward exit face 52 as the strap is threaded into the locking head.

Figure 5:
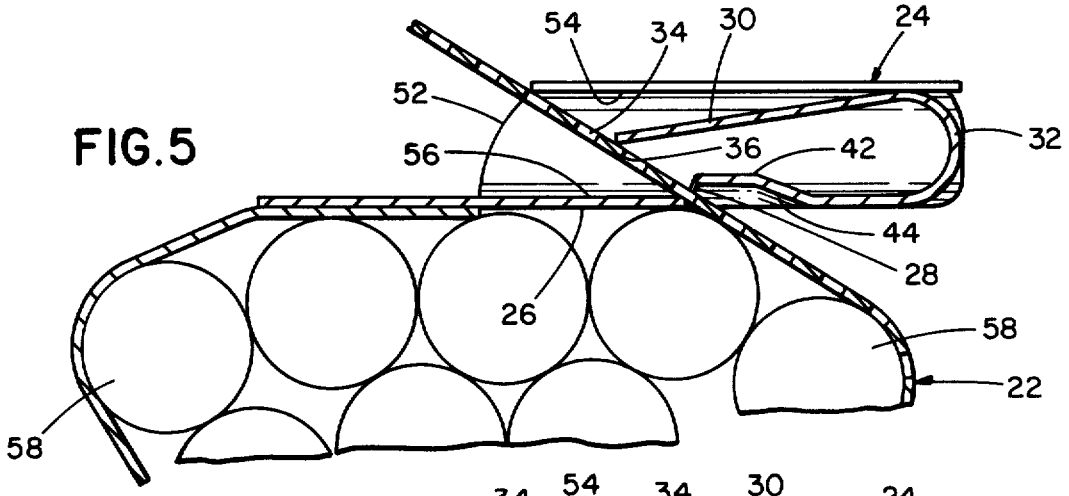
FIG. 5, similar to FIG. 2, is a sectional view showing the strap being threaded into the locking head and the locking tongue being deflected out of locking engagement with the strap.
Figure 6:
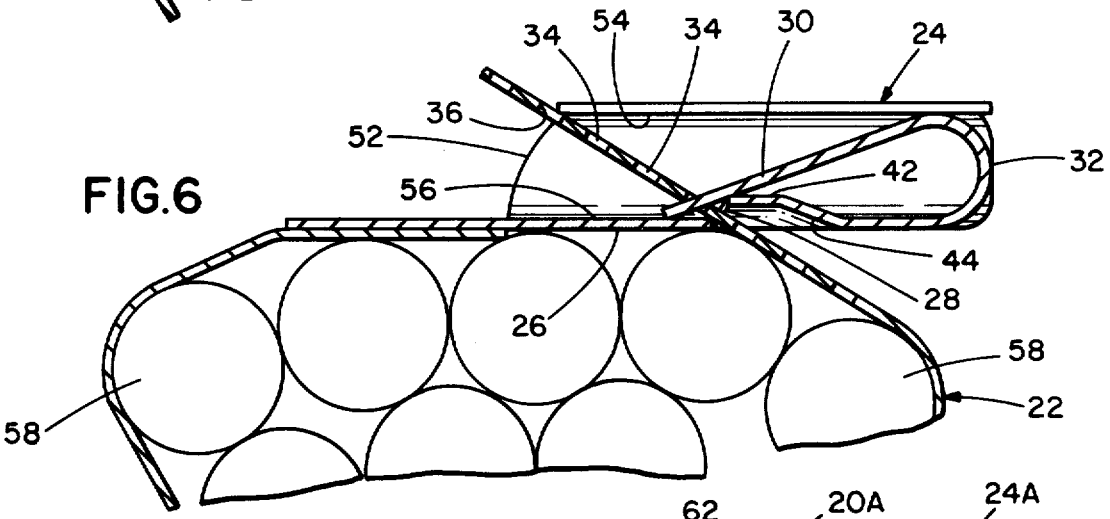
FIG. 6, similar to FIG. 5, is a cross-sectional view illustrating the tie of FIG. 1 holding a plurality of objects with the locking tongue precluding release of the strap from the locking head.

Locking tongue 30 is movable between a threading position, shown in FIG. 5, wherein the tongue is deflected away from floor 26 and out of locking engagement with strap 22, and a locking position, shown in FIG. 6, wherein tongue 30 engages platform 42 and extends through one of the strap apertures 34, securely engaging abutment 36 to preclude removal of the strap from the locking head. The stop means of locking head 24 alternatively comprises a surface 56 of floor 26 for engaging the end of tongue 30. Preferably, of course, the stop means comprises both platform 42 and surface 56. With this configuration it will be appreciated that substantial bending of the tongue is prevented since it is supported adjacent and on each side of the held strap by platform 42 and support surface 56. Furthermore while neck 32 functions to bias tongue 30 toward its locking position, the neck and tongue form a relatively long beam making the tongue easily deflectable toward its threading position thereby providing low force threading of the strap. Of course the spring constant of the tongue and neck can be varied by adjusting the dimensions of the neck and/or tongue.

It should also be noted that in all its positions, the locking tongue is completely disposed within the chamber defined by the side walls, ceiling and floor thereby making the tie of the present invention susceptible for use with a strap-tightening tool of the well-known type which reacts against the locking head's exit face to tighten the strap and is responsive to the development of a predetermined tension in the strap to sever the excess threaded portion of the strap generally flush with the strap exit face. Such a tool will be described more fully hereinafter. Alternatively, the strap can be hand tightened and the excess threaded portion severed by a simple hand tool, e.g. a tin snips. Furthermore after the excess portion of the strap is severed, the cut end of the strap, due to the resiliency of the bundled objects, withdraws slightly inside the locking head. Thus the sharp end of the strap is shieleded and precluded from cutting the user's fingers or damaging the insulation on conductors. In the same vein, it is noted that both sides of strap 22 ar relatively flat and smooth.

Figure 10:
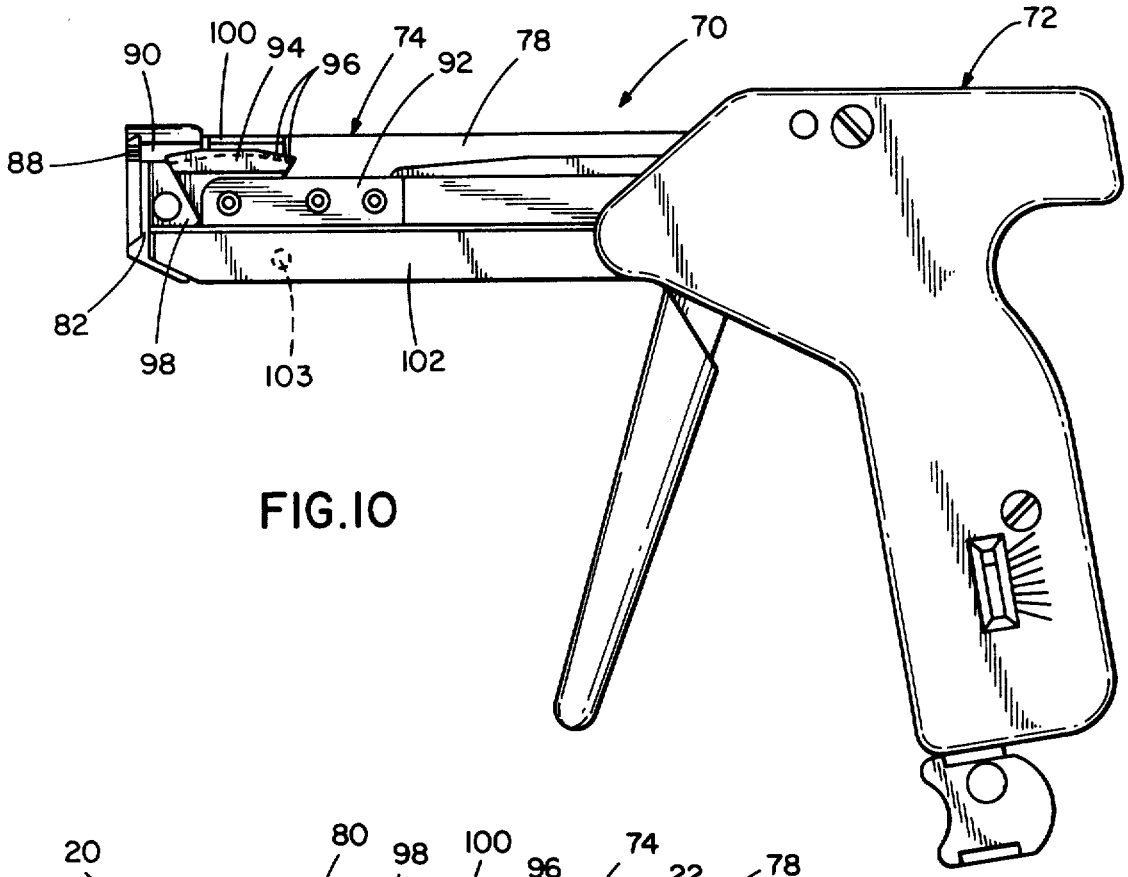
FIG. 10 is a front elevational view of a tool for applying the tie of the present invention including a butt portion and a nose portion.

Referring now to FIG. 10, a strap-tightening tool for use with the metal tie of the present invention is generally indicated by reference numeral 70. Tool 70 is a modified version of a tool for tightening and severing the strap of a plastic cable tie, the latter tool being fully shown and described in commonly assigned U.S. Pat. No. 3,661,187, the teachings of the patent being incorporated herein by reference. Tool 70 includes a butt portion 72 comprising force amplification means for developing a predetermined tension in the strap and further comprising means for initiating cutoff of the excess portion of the strap responsive to the development of the desired strap tension. Butt portion 72 need not further be discussed as it is identical to that shown in the patent.

Tool 70 further comprises a nose portion 74 including components for gripping the strap and for severing the excess portion of the strap after the desired strap tension has been achieved. Nose portion 74 is similar to that shown in the patent so only those components which have been modified or added to accommodate a metal strap, as opposed to a plastic strap, will be fully discussed.

Figure 11:
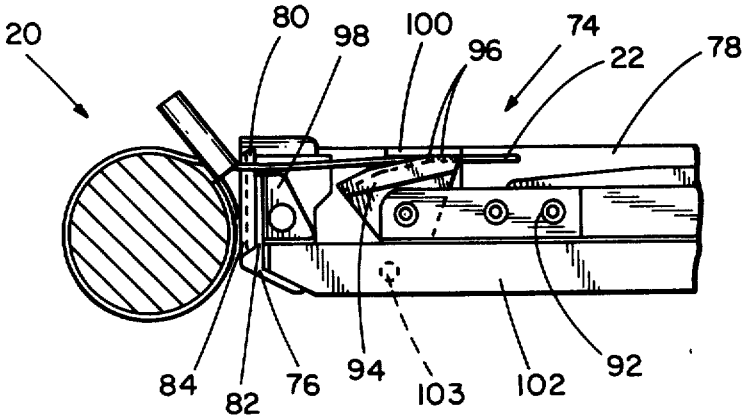
FIG. 11 is a front elevational view of the nose portion of the tool of FIG. 10 illustrating the tie being tightened.

More specifically, as shown in FIG. 11, nose portion 74 terminates in a cutter blade assembly including a cutter blade housing 76 attached to the main casting 78 of the tool. Affixed to housing 76 is a cutter cap 80 with the housing and cap having spaced walls 82, 84, respectively, defining a void in which a cutter 86 is slidably retained. Walls 82 and 84 have respective aligned slots 88, 90 for receiving strap 22 with cutter 86 underlying the strap.

Nose portion 74 also includes a tensioning rod 92 attached to the force amplification means in butt portion 72. Pivotally attached to rod 92 is a gripper 94 having a set of spaced teeth 96 for being received in apertures 34 of strap 22. Gripper 94 is spring biased to an engagement position, shown in FIG. 11, wherein teeth 96 are received within strap apertures 34 and is rotatable therefrom to a release or threading position, shown in FIG. 10, wherein teeth 96 are disengaged from the strap. A triangular abutment 98 extending from casting 78 functions to cam the gripper to its release position. Rod 92 carries a laterally extending finger 100 cooperating with gripper 94 to hold the strap 22 therebetween.

Figure 12:
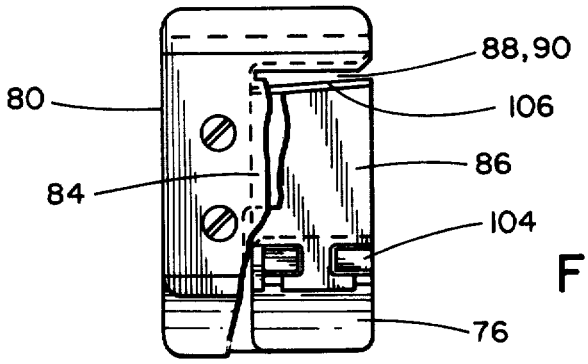
FIG. 12 is a side elevational view of the nose portion with certain components removed.

A cutter lever arm 102 underlying rod 92 is pivotally connected to casting 78 by a pin 103 and extends through an opening in wall 82 of cutter blade housing 76. Arm 102 terminates in a pair of spaced, parallel fingers 104, see FIG. 12, received within slots in cutter 86 for controlling movement of the cutter. Cutter 86 includes a knife edge 106 for severing the strap, the edge (as shown in FIG. 12) being angled at about three degrees with respect to the lower surface of the strap 22 so that the entire knife edge does not simultaneously engage the strap. Angling the knife edge causes a localized stress concentration in the strap so that cutter 86 severs with a slicing action. It will be appreciated that when the desired strap tension is achieved, the cutoff initiation means causes cutter lever arm 102 to pivot about pin 103 with the result that cutter 86 is driven upwardly to sever strap 22.

Operation of the tie of the present invention is as follows: After the tie has been positioned to encompass the objects to be bundled, for example, electrical conductors 58 shown in FIGS. 5 and 6, the distal end of strap 22 is threaded into strap-receiving aperture 28. As threading continues, the strap material between adjacent apertures 34 causes sequential deflection of tongue 30 toward its threading position against the bias of neck 32. After termination of strap tightening forces, tongue 30 extends through one of the strap apertures 34, against the corresponding abutment surface 36, and in supportive engagement with platform 42 and floor support surface 56 thereby precluding release of the strap.

Figure 7:
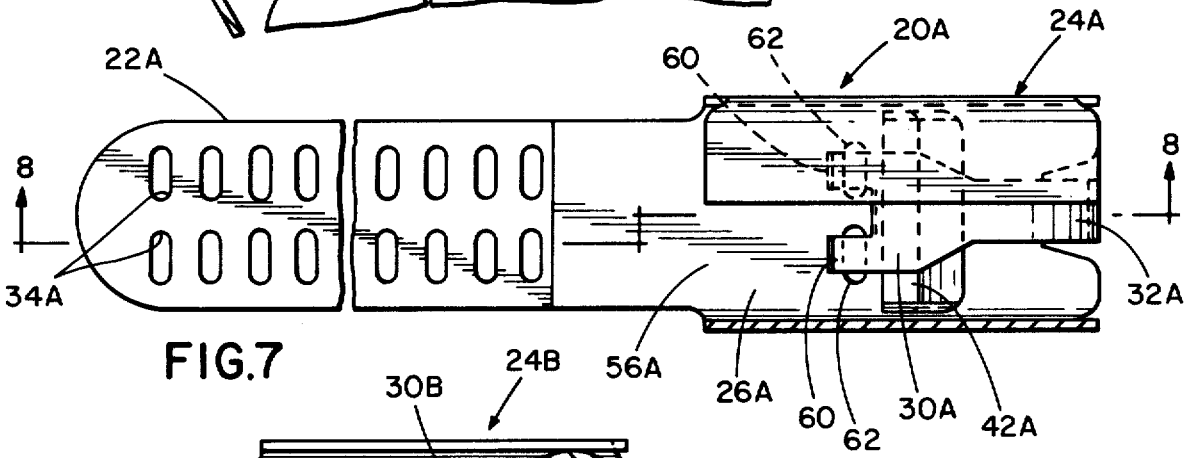
FIG. 7 is a plan of an alternative embodiment of the present invention with certain components removed.
Figure 8:
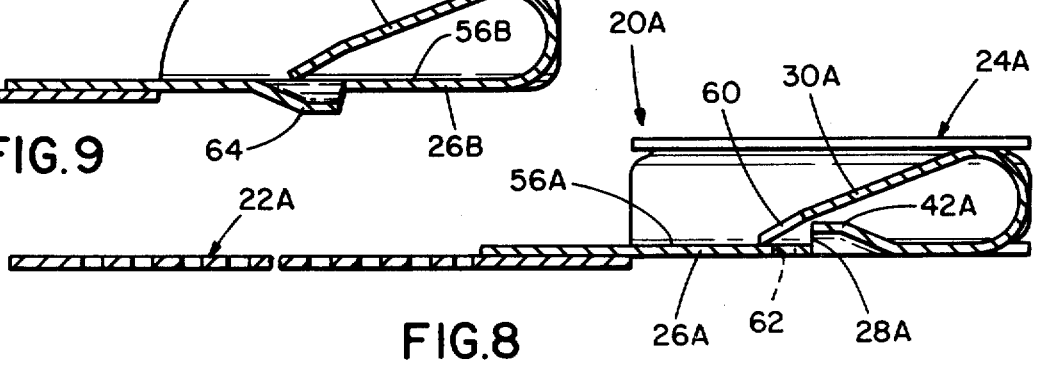
FIG. 8 is a sectional view of the locking head of the tie of FIG. 7 taken generally along line 8—8 of FIG. 7.

An alternate embodiment of the present invention is shown in FIG. 7 at reference numeral 20A. Components of tie 20A corresponding to components of the embodiment of the tie of the present invention previously described are indicated by the addition of the suffix "A" to the reference numeral. Tie 20A is preferable for applications where extremely high tensions are to be developed in the strap. Strap 22A and head 24A preferably have thicknesses of 0.016 inch. The free end of tongue 30A of locking head 24A is bifurcated, terminating a pair of parallel tines 60 which are preferably more sharply inclined toward floor 26A than the remainder of tongue 30A, as shown in FIG. 8. A pair of spaced apertures 62 are provided in floor 26A for receiving tines 60 as will be described more fully hereinafter. Strap 22A includes two parallel rows of spaced apertures 34A with adjacent ones of each row forming pairs for concurrently receiving tines 60 as strap 22A is threaded into locking head 24A.

Operation of tie 20A is similar to that of tie 20 previously described. Note however that after release of a heavily tensioned strap 30A, the strap withdrawal force due to the resiliency of the bundled objects might cause tines 60 to slide along floor support surface 56A in the direction of strap-receiving aperture 28A. But upon the tines' entrance into tine-receiving apertures 62, surfaces partially defining the apertures serve as abutments to restrain further movement of the tines toward the strap-receiving opening 28A. Thus failure of tie 20A due to the tines 60 being deformed about platform 42A so that the tine ends extend through opening 28A is precluded.

Figure 9:
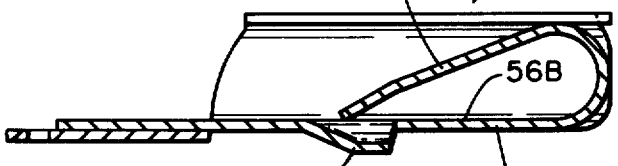
FIG. 9, similar to FIG. 2, shows an alternate embodiment of the locking head of the present invention.

An alternate embodiment of the locking head of the present invention is shown in FIG. 9 at reference numeral 24B. Components of locking head 24B corresponding to components of locking head 24 previously described are indicated by the addition of the suffix "B" to the reference numeral. The stop means of head 24B, instead of comprising a platform, comprises a well 64 for engaging tongue 30B upon attempted retrograde movement of the strap. The free end of the tongue is preferably directed more sharply toward floor 26B than the remainder of the tongue. Operation of head 24B is similar to that of locking head 24 heretofore described.

Figure 13:
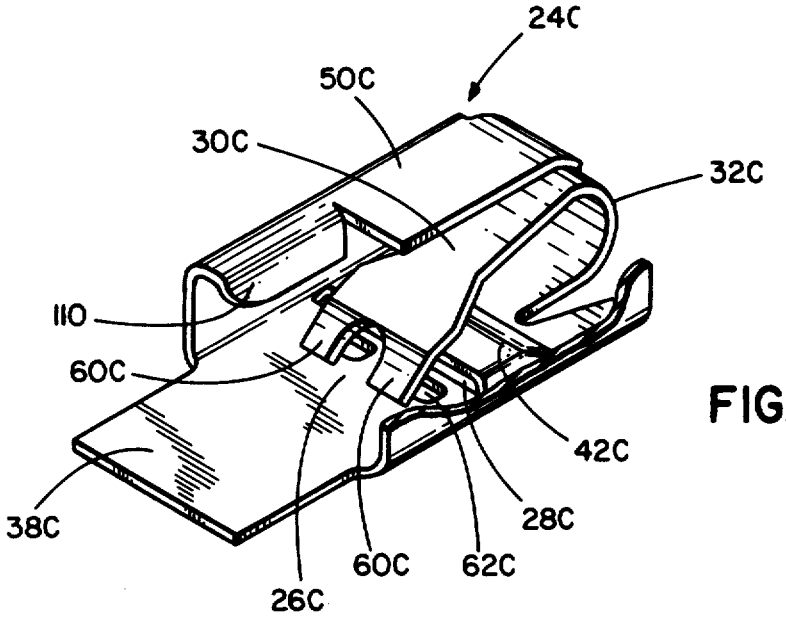
FIG. 13 is a perspective view of an alternate embodiment of the locking head of the present invention, similar to that shown in FIG. 7, with certain components removed.
Figure 14:
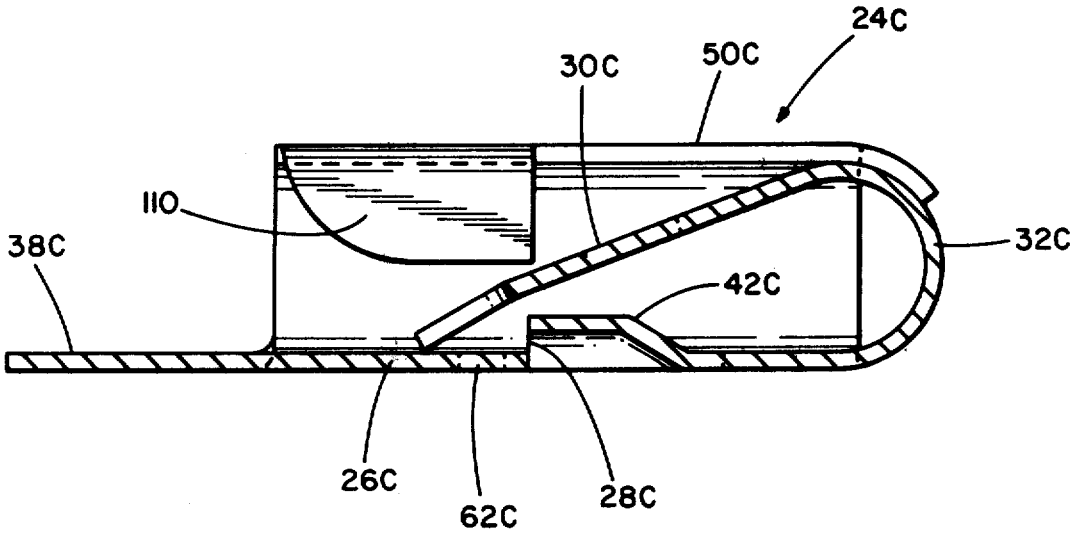
FIG. 14 is an enlarged cross-sectional view of the locking head of FIG. 13.

Another alternate embodiment of the locking head of the present invention is shown in FIGS. 13 and 14 at reference numeral 24C. The various components of locking head 24C corresponding to components of previously described locking heads 24 and 24A are indicated by the addition of the suffix "C" to the reference numeral. Locking head 24C is similar to locking head 24A except that struck from ceiling 50C are a pair of tabs 110 adjacent strap exit face 52C which extend towards the floor 26C. Tabs 110, spaced sufficiently that locking tongue 30C can be deflected therebetween, constitute means for limiting the angle of egress of the excess threaded portion of the strap relative to the exit face of the locking head. This precludes the neck 32C and locking tongue 30C from deformation past their elastic limit to insure that the tongue remains sufficiently biased to lock the strap upon release thereof. It is also noted that the portion of ceiling 50C remote from lip 38C is rounded and engages neck 32C to give locking head 24C a smoother contour.

Although the use of the tie of the present invention has been heretofore described in the context of a conductor bundling application it will be appreciated that such ties are also ideally suited for hose clamp applications or other applications where it is desired to hold two objects in telescopic relationship.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tie for forming a plurality of elongate objects into a bundle and for holding two objects together, said tie comprising:

an elongated strap having a plurality of spaced abutments therealong; and a metal locking head joined to one end of said strap and comprising a floor having a strap-receiving aperture therethrough and further comprising a locking tongue for engaging one of said abutments, said tongue and floor being joined by a resilient neck with said aperture disposed intermediate said one end of the strap and the junction of said neck and floor, said tongue extending from said neck toward said floor to at least partially overlie said aperture whereby threading of said strap causes said tongue to deflect away from said floor and said tongue lockingly engages one of said abutments upon attempted retrograde movement of said strap.

2. A tie as set forth in claim 1 wherein said locking head is of unitary construction.

3. A tie as set forth in claim 2 wherein said strap is made of metal and said head and strap are joined by welding.

4. A tie as set forth in claim 3 wherein said strap and head are made of stainless steel.

5. A tie as set forth in claim 2 wherein said locking head comprises side walls and a ceiling.

6. A tie as set forth in claim 5 in which said floor, side walls and ceiling define a strap exit face of said locking head and wherein said ceiling includes a guide surface for directing said strap toward said exit face.

7. A tie as set forth in claim 6 wherein said locking head comprises means for engaging said strap to limit its angle of egress relative to the exit face of said locking head.

8. A tie as set forth in claim 7 wherein said means for engaging said strap comprises a pair of tabs extending from said ceiling towards said floor and spaced sufficiently that said locking tongue can be deflected between said tabs.

9. A tie as set forth in claim 6 wherein said tongue, in all positions thereof, is disposed within a chamber defined by said floor, ceiling, and side walls.

10. A tie as set forth in claim 2 wherein said locking head comprises a lip extending from said floor adapted for welding to said strap.

11. A tie as set forth in claim 2 wherein said head comprises stop means disposed adjacent said aperture for engaging said tongue upon attempted withdrawal of said strap from said head.

12. A tie as set forth in claim 11 wherein said stop means comprises a platform raised relative to said floor.

13. A tie as set forth in claim 12 wherein said platform includes a guide surface for directing said strap toward said tongue upon incipient threading of said strap through said locking head.

14. A tie as set forth in claim 11 where said stop means comprises a well lowered relative to said floor.

15. A tie as set forth in claim 1 wherein said tongue tapers as it extends from said neck toward said floor.

16. A tie as set forth in claim 1 wherein said strap comprises two spaced longitudinally extending rows of abutments, adjacent ones of each row forming pairs of abutments.

17. A tie as set forth in claim 16 in which said tongue is bifurcated so that the distal end thereof terminates in a pair of spaced tines whereby upon attempted retrograde movement of said strap through said locking head, said tines engage one of said pairs of abutments.

18. A tie as set forth in claim 1 wherein said floor includes an aperture adjacent said strap-receiving aperture for receiving the free end of said tongue.

19. A tie for forming a plurality of elongate objects into a bundle and for holding a pair of objects together, said tie comprising:

an elongate strap having a plurality of spaced, transverse abutments; and a unitary metal locking head joined to one end of said strap and comprising a floor having a strap-receiving aperture, said head further comprising a locking tongue for engaging a predetermined one of said abutments and directed toward said floor and facing a surface of said floor to at least partially overlie said aperture, said head also comprising stop means including means disposed adjacent said aperture for engaging said tongue outside the plane of said floor surface whereby threading of said strap causes said tongue to deflect away from said floor and after tightening of said tie about said objects, said tongue engages one of said abutments and said stop means to prevent retrograde movement of said strap.

20. A tie as set forth in claim 19 wherein said stop means comprises a platform raised relative to said floor.

21. A tie as set forth in claim 20 wherein said strap has a plurality of apertures spaced in the longitudinal direction of said strap for sequentially receiving said tongue during threading of said strap, surfaces of said strap partially defining said apertures constituting said abutments.

22. A tie as set forth in claim 21 wherein said stop means further comprises a surface of said floor with said strap-receiving aperture disposed between said surface and said platform whereby upon attempted loosening of said tie, said tongue is supported adjacent said threaded strap and on both sides thereof.

23. A tie as set forth in claim 19 wherein said stop means comprises a well lowered relative to said floor.

24. A tie for forming a plurality of elongate objects into a bundle and for holding a pair of objects together, said tie comprising:

an elongate strap having a plurality of spaced transverse abutments; and a unitary metal locking head joined to one end of said strap comprising an elongate floor and an extension therefrom terminating in a locking tongue for engaging one of said abutments, said extension being bent back so that said tongue is directed toward said floor, said floor having a strap-receiving aperture with said tongue disposed to at least partially overlie said aperture, said aperture disposed intermediate said one end of the strap and the junction of said floor and said extension whereby threading of said strap causes said tongue to deflect away from said floor and said tongue lockingly engages one of said abutments upon attempted retrograde movement of said strap through said aperture.

* * * * *